US007631533B2

(12) United States Patent
Grimm et al.

(10) Patent No.: US 7,631,533 B2
(45) Date of Patent: Dec. 15, 2009

(54) METHOD AND DEVICE FOR THE PRODUCTION OF STAMPED PARTS

(75) Inventors: Willi Grimm, Kallnach (CH); Shin Takhashi, Hadano (JP)

(73) Assignee: Feintool International Management AG, Lyss (CH)

( * ) Notice: Subject to any disclaimer, the term of this patent is extended or adjusted under 35 U.S.C. 154(b) by 0 days.

(21) Appl. No.: 11/631,713

(22) PCT Filed: Jul. 4, 2005

(86) PCT No.: PCT/EP2005/007180

§ 371 (c)(1),
(2), (4) Date: Feb. 12, 2007

(87) PCT Pub. No.: WO2006/002964

PCT Pub. Date: Jan. 12, 2006

(65) Prior Publication Data

US 2008/0016934 A1 Jan. 24, 2008

(30) Foreign Application Priority Data

Jul. 6, 2004 (DE) ..... 10 2004 032 826

(51) Int. Cl.
*B21D 22/00* (2006.01)
*B21D 45/00* (2006.01)

(52) U.S. Cl. ..... 72/361; 72/427

(58) Field of Classification Search ..... 72/328, 72/344, 361, 420, 421, 426–428, 405.07, 72/404, 405.01
See application file for complete search history.

(56) References Cited

U.S. PATENT DOCUMENTS 2,790,499 A 4/1957 Beisinger et al.

FOREIGN PATENT DOCUMENTS

DE 197 51 238 5/1999
JP 2002-46939 2/2002

*Primary Examiner*—Dana Ross
*Assistant Examiner*—Teresa M Bonk
(74) *Attorney, Agent, or Firm*—Bachman & LaPointe, P.C.

(57) ABSTRACT

A method for the production of stamped part in a tool, particularly a fine cutting tool, by means of at least one stamp which is used to press the stamped part from a strip of material. According to the inventive method, the stamped part is moved from the material strip to a discharge element after it has been pressed from the material strip.

6 Claims, 2 Drawing Sheets

METHOD AND DEVICE FOR THE PRODUCTION OF STAMPED PARTS

BACKGROUND OF THE INVENTION

The invention relates to a method for production of stampings in a die, in particular a precision blanking die, by means of at least one punch with which the stamping is pressed out of a material strip, wherein after being pressed out of the material strip, the stamping is pushed by this strip to a discharge facility.

Stampings are generally produced today on punching machines in a die comprising an upper and a lower die half, between which a material strip is clamped. Corresponding punches then press the stamping out of the material strip. These stampings are ejected when the die is opened.

A sub-form of punching is precision blanking. A corresponding precision blanking arrangement is illustrated, for example, in DE 35 76 129 A1. A die for precision blanking can be found in DE 197 51 238 A1.

Problems are posed among other things by the discharge of the stampings. This is effected, for example, by blowing out or by means of special removal arrangements. The removal is normally unsorted or requires a great deal of outlay.

In some cases the stamping is also pressed back into the material strip and discharged with the material strip. This pressing back has the disadvantage, however, that the stamping often suffers damage to the functional surfaces.

A method is known from JP 02 046936 A in which two projections are pressed out of a material strip behind the stamping that carry the stamping along to a discharge facility. In a similar manner according to U.S. Pat. No. 2,790,499, a bridge-like opening is pressed out behind the stamping, with the material strip also being raised in this area behind the stamping, and this bridge-like opening carries the stamping along with it to a discharge chute.

The object of the present invention is to develop a method and an arrangement of the above-mentioned type with which the stamping can be discharged simply, in a sorted manner and free from damage.

SUMMARY OF THE INVENTION

The object is achieved in that a protruding section is used or is additionally formed on the stamping by means of which the material strip carries the stamping along.

In one preferred exemplary embodiment, the punch works together with a pressure pad in a die plate. During blanking of the stamping, the stamping is pressed into the die plate against the force of the pressure pad. If the die plate is now removed from the punch, the pressure pad pushes the stamping out of the die plate again so that it preferably comes to rest on the surface of the die plate. The stamping is then pushed along this surface up to the discharge facility by means of the material strip.

In order that the stamping can be brought to the surface of the die plate without interference by the material strip, the material strip has to be raised relative to the die plate. A device is provided for this purpose that determines the position of the material strip relative to the die plate and, if provided, also relative to the press platen in which the punch is guided. A large number of exemplary embodiments can be provided for this device. In one simple exemplary embodiment, the strip guides are used that already hold the material strip between them and guide it through the blanking die according to the prior art. These strip guides are now designed in such a way that they form a receptacle with which it is possible to move the material strip relative to the die plate and/or relative to the press platen. For this purpose it may be advisable that this receptacle can be moved parallel to the punch and/or to the pressure pad.

Raising the material strip to a defined distance from the die plate ensures that the stamping can be ejected out of the die plate and lies on the surface of the die plate below the material strip.

In order for the material strip to now also be able to push the stamping ahead of it during its further transport, it is necessary for there to be a corresponding abutment on the stamping. In other words an elevation is formed on the stamping that is contacted by a control edge on the material strip.

A suitable discharge facility is a simple discharge chute provided in the transport direction of the material strip. As a result, the punching process as a whole is not hindered.

The respective die according to the invention can naturally also comprise further inside punches with which preforming or inside forming processes can be performed. This is effected in the parallel direction to the punch, i.e. generally perpendicular to the feed direction of the material strip.

The method according to the invention and the corresponding arrangement have the great advantage that the stampings, in particular precision blankings, leave the die space separately from the inside forming and preforming wastes. This takes place without damage, as there is no risk of them remaining between the two die halves and being damaged during a subsequent punching process.

No additional handling components are necessary for the removal of the stampings. Due to the forced discharge of the stampings with the material strip, the overall punch stroke of the press can be reduced. This allows the cycle rate to be significantly increased.

BRIEF DESCRIPTION OF THE DRAWINGS

Further advantages, features and details of the invention can be seen from the following description of preferred exemplary embodiments and from the drawing in which.

DETAILED DESCRIPTION

Figure 1:
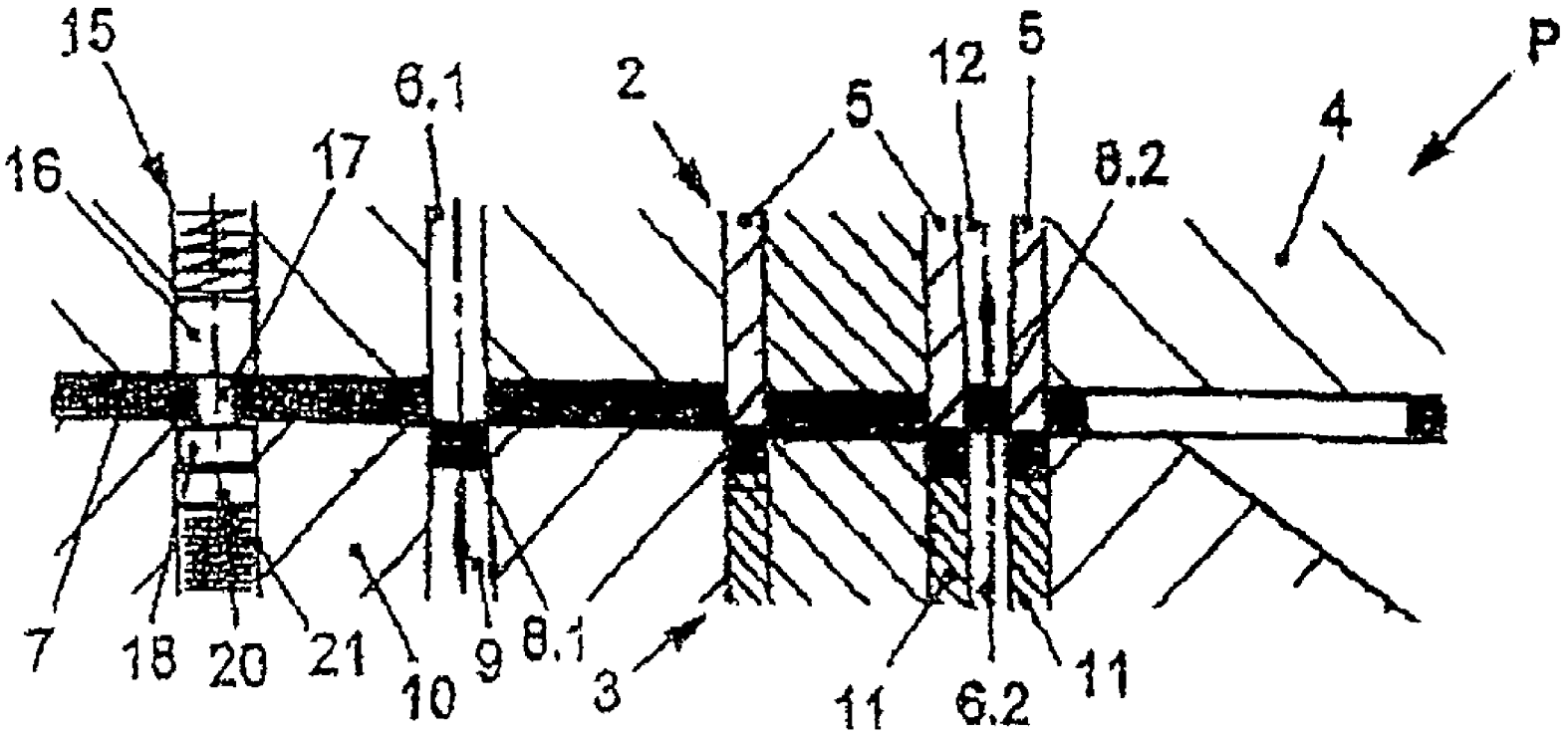
FIG. 1 shows a schematic partial longitudinal section through an arrangement for production of stampings according to the invention.

FIG. 1 shows a part of a die P of an arrangement for the production of stampings 1.1 according to the invention, namely part of an upper die half 2 and of a lower die half 3.

A press platen 4 of the upper die half 2 is partially shown in which a punch 5 for cutting out the stamping 1.1 is guided. In addition, further inside forming punches 6.1 and 6.2 can be seen with which preforming and/or inside forming wastes are cut out from a material strip 7 in the through-cutting process. A resulting waste piece 8.1 drops through a conically widening bore 9 into a die plate 10.

In the die plate 10, a pressure pad 11 is assigned to the punch 5, whereby a further inside forming punch 6.2 is guided in the pressure pad 11, by means of which a waste piece 8.2 is pressed into a conically widening bore 12 in the punch 5 and is discharged through this bore.

Figure 2:
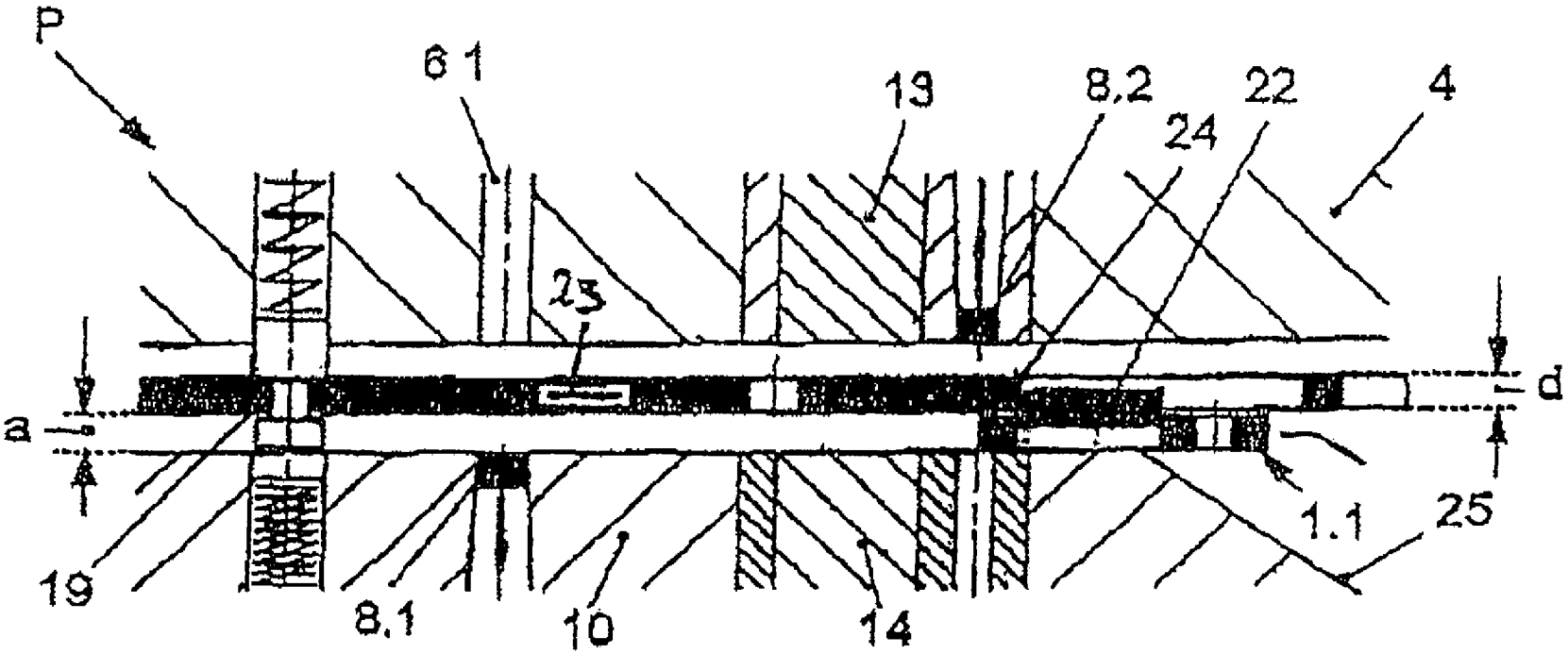
FIG. 2 shows the longitudinal cross section according to FIG. 1 in a further working position.

A pressure punch 13 and a counter-punch 14 are each also guided in the punch 5 and in the pressure pad 11 (see FIG. 2).

A device 15 for lifting the material strip 7 is also assigned to the material strip 7. This has a ram 16 guided in the press platen 4 to which a stem section 17 with a smaller diameter followed by a guide ram 18 with a larger diameter is assigned. This forms a receptacle 19 in the area of the stem section 17 between ram 16 and guide ram 18 in which the material strip 7 is guided and held.

The functional principle of the present invention is as follows:

The material strip 7, guided in the device 15 for lifting the material strip 7, is inserted between the upper and the lower die half 2 and 3 respectively. The die P is closed, whereby the guide ram 18 is inserted into a guide bore 21 in the die plate 10 against a spring-loaded counter-ram 20.

The inside forming punch 6 cuts the waste piece 8.1 out of the material strip 7, said waste piece then dropping down and away through the bore 9.

The stamping 1.1 is cut out of the material strip 7 with the punch 5, whereby pressure punch 13 and counter-punch 14 are adjusted in such a way that an upward protruding supporting part 22 is formed on the stamping 1.1.

The inside forming punch 6.2 ejects the waste piece 8.2 through the bore 12 in the punch 5.

The die P is now opened as shown in FIG. 2, whereby the die plate 10 moves away from the press platen 4. This movement is also made partially by the ram 16 so that the material strip 7 is lifted off the press platen 4. The device 15 is adjusted in such a way, however, that the material strip 7 is also lifted off the die plate 10 and maintains a defined distance a from said die plate that is at least as large as the thickness d of the material strip 7.

At the same time the material strip 7 is moved to the right, as indicated by the arrow 23. A control edge 24 of the material strip 7 thereby contacts the supporting part 22 of the stamping 1.1 and carries this stamping 1.1 with it up to a discharge facility formed by a discharge chute 25. The stamping 1.1 slides down the discharge chute 25 and onto a discharge conveyor belt where it is then carried away for further processing.

The invention claimed is:

1. A method for producing stampings in a precision blanking die comprising the steps of:

feeding a material strip to a die opening in a die in a feed direction;

closing the die in a punching direction to produce a stamping from the material strip wherein the stamping is formed with a supporting part protruding in an opposite direction of the punching direction of the stamping and the material strip following in the feed direction is formed with a control edge;

opening the die; and further feeding the material strip following in the feed direction through the die opening wherein the control edge of the material strip following in the feed direction contacts the protruding supporting part of the stamping for moving the stamping to a discharge chute.

2. A method according to claim 1, wherein the die comprises a press platen and a die plate which define the die opening, the platen is provided with a punch which interacts with a pressure pad in the die plate when the punch produces the stamping.

3. The method as claimed in claim 2, wherein the pressure pad lifts the stamping to the die plate when the die is opened.

4. The method as claimed in claim 3, including providing a lifting device for lifting the material strip off the die plate when the die is opened.

5. The method as claimed in claim 4, wherein the material strip is lifted off the die plate to a defined distance (a) from said die plate surface that corresponds to at least a thickness (d) of the stamping.

6. The method as claimed in claim 1, wherein the material strip is fed horizontally.

* * * * *